United States Patent [19]

Midzutani et al.

[11] 4,122,696

[45] Oct. 31, 1978

[54] METHOD AND APPARATUS FOR MANUFACTURING METALLIC PIPE

[75] Inventors: Wataru Midzutani, Kitakyshu; Koe Nakajima, Nakama; Toshio Kikuma, Onga; Keitaku Ondo, Kitakyushu, all of Japan

[73] Assignee: Nippon Steel Corporation, Tokyo, Japan

[21] Appl. No.: 789,716

[22] Filed: Apr. 21, 1977

[30] Foreign Application Priority Data

| | | | |
|---|---|---|---|
| Dec. 13, 1976 | [JP] | Japan | 51-149519 |
| Dec. 13, 1976 | [JP] | Japan | 51-149520 |
| Dec. 30, 1976 | [JP] | Japan | 52-159254 |
| Jan. 17, 1977 | [JP] | Japan | 52-3729 |

[51] Int. Cl.[2] ..... B21D 39/02; B21D 5/12

[52] U.S. Cl. ..... 72/52; 72/178; 72/181; 72/368

[58] Field of Search ..... 72/51, 52, 178, 181, 72/182, 368; 228/146, 147, 150, 151

[56] References Cited

U.S. PATENT DOCUMENTS

| | | | |
|---|---|---|---|
| 672,689 | 4/1901 | Whitehouse | 72/52 |
| 1,989,059 | 1/1935 | Kurtze | 72/178 |
| 2,007,284 | 7/1935 | Rafter | 72/178 |
| 2,012,795 | 8/1935 | Park | 72/181 |
| 2,037,608 | 4/1936 | Walker | 72/181 |
| 2,098,989 | 11/1937 | Yoder | 228/151 |

FOREIGN PATENT DOCUMENTS

| | | | |
|---|---|---|---|
| 831,534 | 2/1952 | Fed. Rep. of Germany | 72/52 |
| 1,016,675 | 10/1957 | Fed. Rep. of Germany | 72/182 |
| 950,719 | 2/1964 | United Kingdom | 72/178 |
| 1,433,431 | 4/1976 | United Kingdom | 72/368 |
| 192,153 | 4/1967 | U.S.S.R. | 72/181 |

*Primary Examiner*—E. M. Combs

[57] ABSTRACT

In a method and an apparatus for manufacturing a metal pipe wherein a flat strip or skelp is formed into a cylindrical pipe while being fed in its longitudinal direction by a forming mill having a prefinishing stand, a train of forming stands for forming the skelp with a U-shaped cross section, and a train of finishing stands, the improvement wherein both edge surfaces of the skelp are caused to contact in substantially point contact recess-defining surfaces of concave V-shaped recess in pairs of forming rolls, the respective rolls which are disposed symmetrically in a plane normal to the pass line as the skelp moves through the train of forming stands along the line, and the skelp has a bending load applied by the forming rolls so as to form the skelp into a U-shaped skelp. According to this method and apparatus, there is no need to change the forming rolls even if the diameter or wall thickness of the pipe to be manufactured are changed, and also since the skelp edge is held, during the forming process, at positions in a plane normal to the pass direction by the surfaces of the concave recesses, the skelp is not twisted around the pass line so that threading of the forming mill can be carried out accurately and easily.

16 Claims, 22 Drawing Figures

59
58
57
60
1

64
63
62
65
1

47
48
1

54
53
52
55
1

40
39
41
1

44
43
45
1

METHOD AND APPARATUS FOR MANUFACTURING METALLIC PIPE

BACKGROUND OF THE INVENTION

The present invention relates to a method and apparatus for manufacturing metal pipe and more particularly to a forming method and apparatus for manufacture of electrically welded pipe.

Heretofore, for forming pipe or tube from a flat strip or a skelp, the following processes have been carried out.

(1) For rough forming, a skelp is fed into a pass formed by upper and lower rolls having a convex curved surface and concave curved surface respectively, and the skelp is thereby formed into a shallow U-shaped cross section by the engagement of upper and lower surfaces by the rolls.

(2) For intermediate forming, the U-shaped skelp is acted on by vertical rolls having concave curved surfaces designed to contact the entire outer surface of the skelp to bend the shallow U-shaped cross section skelp into a deep U-shaped cross-section skelp.

(3) For finish forming, pressure is applied in the width direction of the skelp by means of fin rolls designed to contact almost the entire outer surface of the skelp and the end portion of the skelp is held.

(4) Driving rolls drive the rough forming, intermediate forming and finish forming rolls respectively.

In the foregoing conventional processes, there exist the following problems.

(1) Since the skelp edge is threaded into the forming mill without the leading end being held, the cross section in the width direction of the skelp does not remain symmetrical with respect to the centerline of the pass due to non-uniformity or error in roll setting precision, etc., and biting into the fin pass stand is not carried out smoothly, thereby making the threading tremendously difficult and reducing the working efficiency and also making the operation impossible without a high degree of skill. The range of interchangeability of roll sizes in the rough forming and intermediate forming passes is extremely narrow, and separate sets of rolls are usually required to be provided for each diameter of pipe to be manufactured, and as a result, the roll cost is high.

(3) Roll change-over required for a change of diameter of the pipe to be manufactured takes a long time reducing the operating ratio of the apparatus and causing the productivity to be extremely low.

(4) Since the rolls and the skelp are in full contact with one another over the entire outside surface of the skelp, slipping occurs due to differences in peripheral speeds of the rolls and the skelp, thereby causing tremendous energy loss during the forming.

The present invention seeks to solve the foregoing problems.

SUMMARY OF THE INVENTION

An object of the present invention is to solve the above-noted technical difficulties and to provide a method and apparatus for forming of pipe by rolling which reduces the number of passes and for forming a skelp into a cylindrical pipe having a circular cross-section, reducing the number of rolls needed to form cylindrical pipes of various sizes (pipe diameter and pipe wall thickness), and at the same time to improve the ability to operate the apparatus by increasing the ease of threading and also reducing the energy loss by reducing the degree of contact of the skelp with the rolls and improving the productivity tremendously.

In order to achieve the foregoing variety of objects. The present invention provides a method and apparatus wherein a flat-skelp is formed into an O-shaped cross-section while being fed in its longitudinal direction by a forming mill comprised of a prefinishing stand, a train of stands for bending the skelp into a U-shape and a train of finishing stands. In the apparatus, both edge surfaces of skelp are caused to make a substantially point contact with the surfaces defining concave recess in pairs of forming rolls, the rolls of each pair being rotatably mounted symmetrically with respect to a plane normal to the pass line, and the pairs of rolls constituting the train of bending stands along the line, and the skelp is caused to be held by the forming rolls so as to apply a bending load to the skelp thereby forming the skelp into a deep U-shaped skelp.

DESCRIPTION OF THE PREFERRED EMBODIMENT

For manufacturing a cylindrical pipe according to the present invention, a metal sheet, for example, a steel strip, or skelp, a sheared sheet, or the like is used as the starting material, but such a starting material is not supplied directly to the forming stands in the roll forming method according to the present invention but instead the flat starting material is supplied to the forming stands by means of a skelp feeding apparatus to be described hereinafter.

The skelp feeding apparatus is operated to cause the starting material to travel in the direction of the train of forming stands and the tip of the starting material is fed into the forming stands so as to load the skelp into the forming stands.

The opposite side edges of the skelp fed into the forming stand are held by a succession of pairs of rotable forming rolls with the rolls of each pair disposed symmetrically relative to a line normal to the pass line so that the surfaces of the edges come into substantially point contact with the surfaces of concave V-shaped recess formed in the forming rolls, or at most line contact of the edges in the direction of the thickness of the skelp, and bending stress is applied thereto thereby forming the skelp into a U-shaped skelp. The closer the pairs of forming rolls toward the output end of the forming mill the smaller the intervals between the concave recesses in the forming rolls of the forming mill, and the skelp is shaped into the U-shaped skelp by being bent into a gradually increasing curvature.

The U-shaped skelp is prefinished by means of a pair of concave vertical prefinishing rolls having a curvature smaller than the U-shaped curvature of the skelp from the last pair of forming rolls for aiding in the bending of the skelp from the U-shaped cross section to the O-shaped cross section.

The U-shaped skelp is finished by being formed into an O-shaped cross section by means of a train of finish forming stands each provided with the fin pass rolls.

Embodiment 1.

Figure 1:
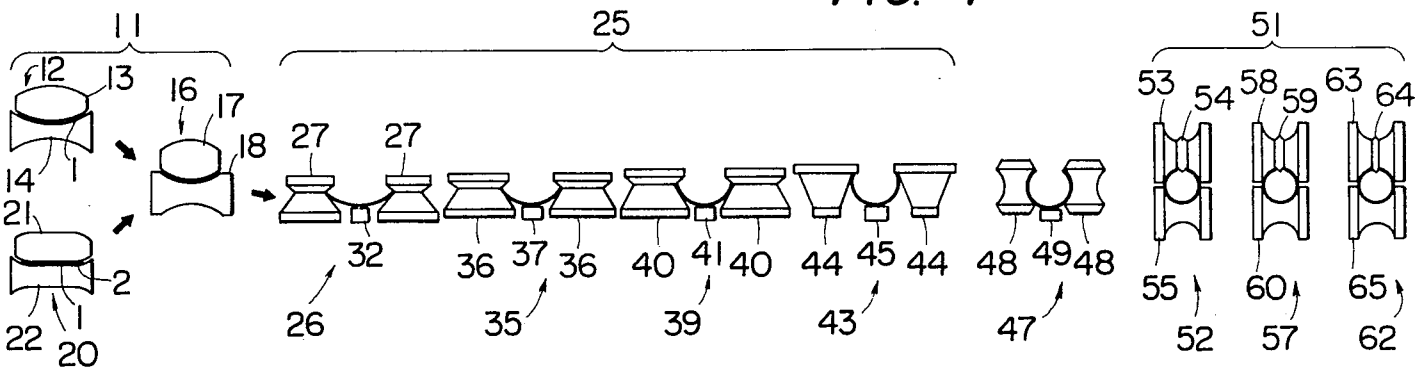
FIG. 1 is a schematic drawing illustrating one example of a forming mill according to the present invention.

As shown in FIG. 1, the forming mill is comprised of a skelp feeding apparatus constituted by a train of pinch roll stands 11, a forming means constituted by a train of U-shape forming stands 25, a prefinishing stand 47 and a train of finishing stands 51.

The skelp 1 is fed into the train of the U-shape forming stands 25 by means of a first pinch roll stand 12 consisting of a convex top roll 13 and a concave bottom roll 14 and a second pinch roll stand 16 consisting of a convex top roll 17 and concave bottom roll 18. The profile of these pinch rolls is selected for preforming the entire width of the skelp 1 by means of the pairs of a convex top roll and a concave bottom roll, the roll profile having single radius or uniform curvature like the rolls 13 and 14, or having a central portion which is linear like the rolls 21 and 22 and having only the edge portions curved so that only the edge portions of the skelp 1 are prebent.

Figure 2:
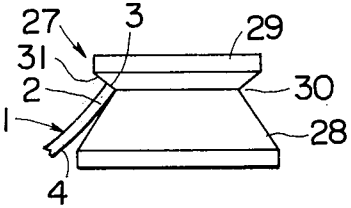
FIG. 2 is a elevation view, on an enlarged scale of a forming roll for use in the forming mill of FIG. 1 and showing the point contact of the edge of the skelp with the roll surface.

The rolls of the first and second pinch roll stands 12 and 16 are operated in such a way that at the time of threading of the skelp 1 into the U-shaped forming stands either the top or bottom rolls, or both are driven to feed the skelp 1 into the train of the U-shape forming stands 25 and to pass it through the prefinishing stand 47 and then to feed it into the train of the finishing stands 51. After the skelp 1 has been engaged by the rolls of the finishing stands and the forming of the skelp is being carried out with stability, the pinch rollers can be set in the non-drive condition. Thereafter, the skelp 1 is pulled by the finishing rolls of the finishing stand 51, squeeze rolls and sizing rolls (not shown). Both edges of the skelp 1 are engaged by the rolls of the first U-shape forming stand 26 which are constituted by a pair of vertical rolls 27 and a bottom (horizontal) roll 32. As shown in FIG. 2, the edges are held by the concave V-shaped notches 30 defined between the surfaces of the barrel portion 28 and the flange portion 29 provided on the top of the barrel portion 28, and the center of the width of the skelp 1 is supported by the bottom roll 32. As a result, the skelp 1 is supported at three points, and is in a condition to receive the bending load whereby the skelp 1 is formed into an arc-shaped cross-section. In this case, as shown in FIG. 2, both edge surfaces 3 of the skelp 1 are held in line contact with the surface 31 of the flange portion 29 defining part of the concave recess 30 in the thickness direction of the skelp 1. That is, the concave recess 30 restrains movement of the edge portion 2 in the direction of the outer surface 4 of the skelp. Since both edge portions 2 of the skelp 1 are held as described above, the skelp 1 is firmly gripped by the vertical rolls 27 and the skelp 1 is curved into the arcuate shape without being twisted around the pass line and without being warped.

The concave recess in the vertical roll may be formed by an upright conical rotary body on the barrel portion and a inverted conical rotary body on the flange portion, which is coaxial with the upright conical body, and the apexes of which bodies are joined. The two conical surfaces forming the concave recess are generally normal to one another.

The shape of the forming roll is preferably designed to enable the outer surface 4 of the skelp 1 to contact the rolls in substantially point contact to minimize the friction between the roll and the skelp, and the vertical rolls 27 are preferably made double conical in shape as described above and also the horizontal roll 32 is made cylindrical in shape for the same reason. Furthermore, the flange 29 of the vertical roll 27 is provided as a guide to prevent asymmetric forming of the skelp 1, but in order to minimize the friction between the flange 29 and skelp 1, and thus reduce power consumption, it is preferable to make the flange 29 freely rotable independently of the portion 28. As will be described hereinafter, a position change mechanism is provided for the rolls 27 and 32 for causing the vertical rolls 27 to perform opening and closing movement (right and left direction) and vertical movement, and the bottom roll 32 is moved vertically, and the mechanism is preferably caused to respond rapidly to the adjustment of the shape of the skelp 1 as well as a change in the size of the skelp, etc.

The vertical rolls 36 and the horizontal roll 37 of the second U-shape forming stand 35, the vertical rolls 40 and the horizontal roll 41 of the third U-shape forming stand 39, the vertical rolls 44 and the horizontal roll 45 of the fourth U-shape forming stand 43, respectively, have a shape similar to the shape of the vertical rolls 27 and the horizontal roll 32 of the first U-shape forming stand 26. Also, the rolls of the first U-shape forming stand 26, the second U-shape forming stand 35, and the third U-shape forming stand 39 have increasingly steeper inclinations of the conical surfaces of the barrel portions; that is, the conical surface of the barrel portion of the rolls of the third forming stand has a steeper inclination than that of the rolls of the second forming stand. In the fourth U-shape forming stand 43, the vertical rolls 44 are inverted, and the rolls have an inverted truncated conical shape. In this fourth U-shape forming stand 43, which is different from the U-shape forming stands of the preceding steps, the marginal edges of the skelp 1 or the outer surface in the vicinity thereof come into contact with the concave recess.

With the shaped rolls as described, the skelp edge portion 2 having a cross section resembling a circular shape can be accurately held.

The prefinishing stand 47 provided just before the train of the finishing stands 51 is comprised of a pair of concave vertical rolls 48 and a flat profile bottom roll 49, which accelerates the forming of the skelp 1 the forming of which has substantially approached roundness. Because the curvature of the concave surface of the vertical rolls 48 is less than that of the skelp 1, the surface of the rolls 48 and the outer surface 4 of the skelp 1 are, strictly speaking, in point contact.

The rolls of the train of finishing stands 51 are fin pass rolls, and have a roll shape similar to conventional rolls and are provided with a drive device. That is the first finishing stand 52 is comprised of a top roll 53 provided with a fin 54 and a bottom roll 55, and the second finishing stand 57 is comprised of a top roll 58 provided with a fin 59 and a bottom roll 60, and moreover the third finishing stand 62 is comprised of a top roll 63 provided with a fin 64 and a bottom roll 65.

Figure 3A:
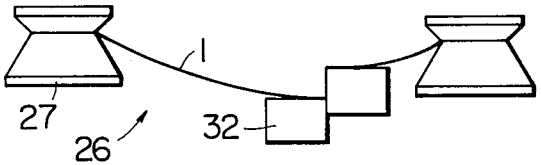
FIGS. 3*a* – 3*h* are schematic views illustrating the relationship of different skelps and rolls of stands constituting the forming mill illustrated in FIG. 1, the left hand sides of the figures showing a skelp and relative roll position for a large diameter pipe and the right hand sides of the figures showing the same for a small diameter pipe, FIGS. 3*a* – 3*d* illustrating the arrangement of the rolls in bending stands for bending the skelp into a deep U-shaped skelp, FIG. 3*e* illustrating the rolls of a prefinishing stand and FIGS. 3*f* – 3*h* illustrating the arrangement of the rolls of the finishing stands.
Figure 3B:
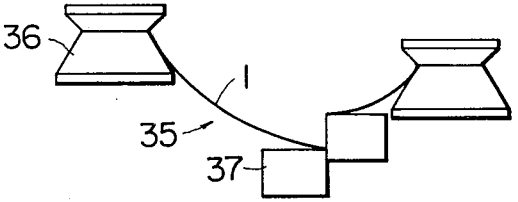
Figures 3C, 3D, 3E, 3F, 3G, 3H:
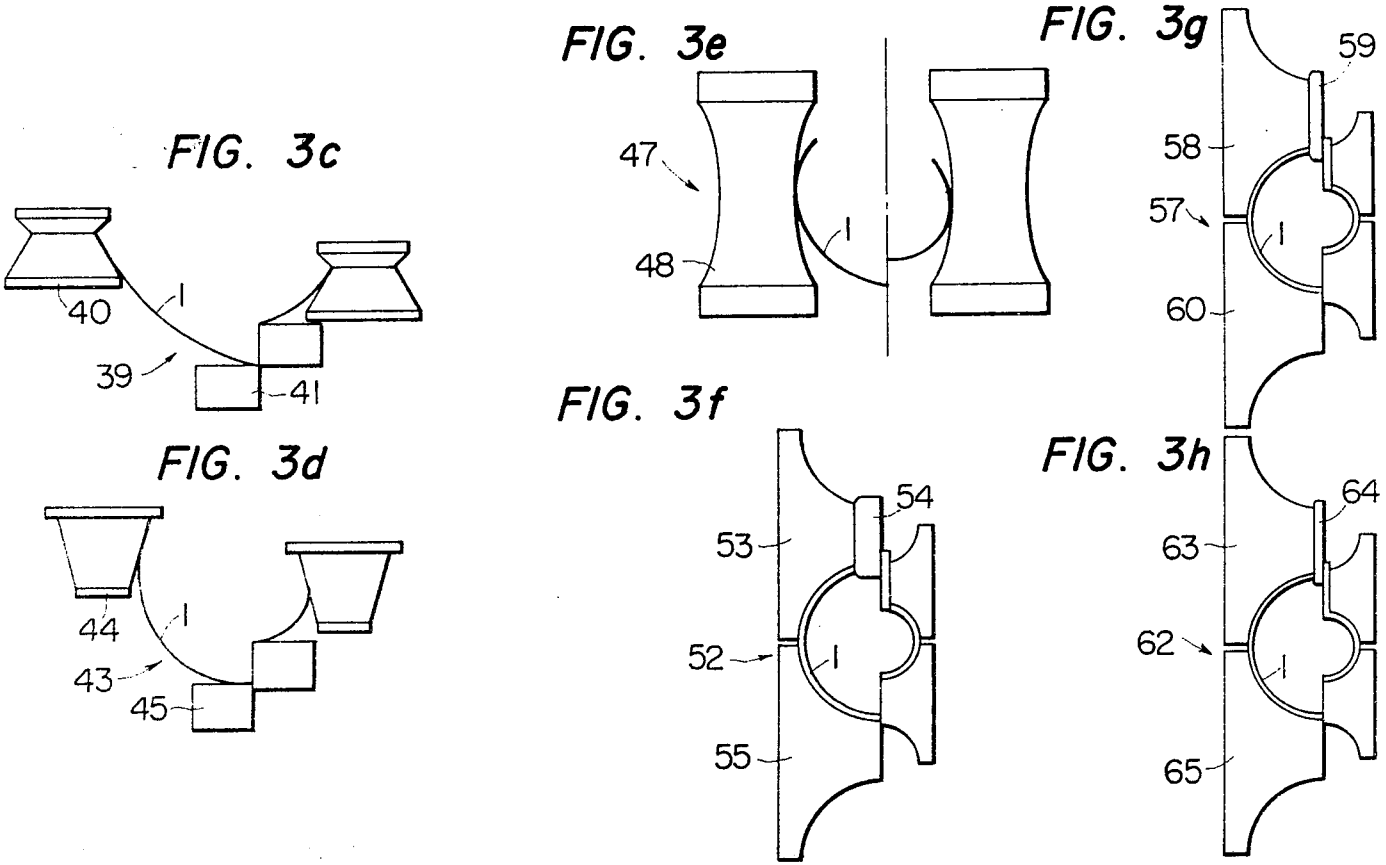

The different arrangements of rolls and the manners in which the rolls contact the skelp 1 when manufacturing pipes of different diameters by using the above-described forming stands is illustrated in the parts of FIG. 3. In each part of FIG. 3 the roll arrangements and the way in which the rolls engage the skelp for forming a pipe of large diameter is illustrated on the left side of the figure and the roll arrangement and the engagement for forming a pipe of small diameter is illustrated on the right side of the figure. FIGS. 3*a* - 3*d* illustrate the arrangement of the rolls of the U-shape forming stands in the order of the stands along the forming mill, and the intervals between the concave recesses in the rolls of each pair become gradually less. FIG. 3*e* illustrates the rolls of the prefinishing stand 47. In FIGS. 3*a* - 3*e* the rolls in each pair are identical, only the relative positions of the rolls in each pass being changed. Also, FIGS. 3*f* - 3*h* illustrate the fin pass rolls of the finishing stands which are in the order of the stands, in the train of finishing stands and the gap between the edges of the skelp 1 is made gradually narrower, and the whole skelp approaches the round cross-section.

As will be obvious from the parts of FIG. 3, the shape of the forming rolls used in the present invention is not required to be changed to produce pipe of a different diameter. The forming rolls are merely shifted and held at the shifted position thereby enabling coarse and intermediate forming of pipes having different diameters by means of identical rolls.

As the result of the use of the present invention having the foregoing features, the number of pairs of rolls required for U-shape forming stands for producing eight sizes of pipe having diameters in the range of 1 inch $\phi$ to 3 inch $\phi$ is reduced from 114 to 14, as shown in Table 1.

Table 1

| | Conventional Methods | | | Embodiment of Present Invention | | |
|---|---|---|---|---|---|---|
| | number of stands | number of sets | rolls | number of stands | number of sets | rolls |
| Pinch roll | 1 | 1 | 2 | 2 | 1 | 4 |
| Rough roll | 4 | 8 | 64 | | | |
| Intermediate roll | 3 | 8 | 48 | 5 | 1 | 10 |

Table 1-continued

| | Conventional Methods | | | Embodiment of Present Invention | | |
|---|---|---|---|---|---|---|
| | number of stands | number of sets | rolls | number of stands | number of sets | rolls |
| Total | | | 114 | | | 14 |

Furthermore, the time required for changing the forming mill to produce a different diameter pipe is reduced from 80 hours per month to 40 hours per month. Also, electric power consumption for forming a cylindrical pipe of 3 inch $\phi$ from a skelp having a yield stress of 43 kg/mm$^2$ is reduced by about 10% as compared with the conventional methods.

The structure of the forming mill illustrated in FIG. 1 as described in the foregoing is a basic design suitable for the forming of a thin wall pipe having a small diameter.

Figure 4:
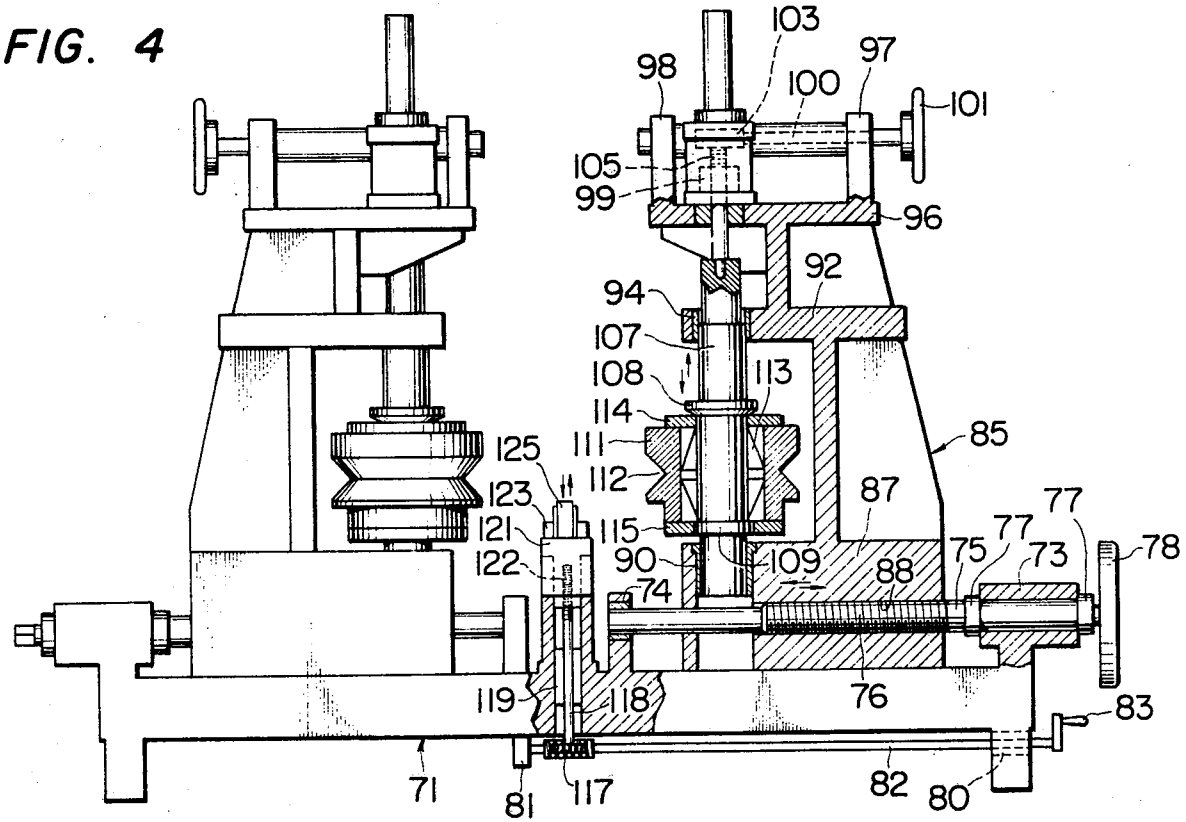
FIG. 4 is an elevation view, partly in section, of a bending stand.

FIG. 4 illustrates one example of a U-shape forming stand.

A pair of movable base members 85 which are capable of shifting in the right and left directions are mounted on a base frame 71 in spaced opposed positions. On each side of the base frame 71 are bearings 73 and 74 and a horizontal drive rod 75 having a threaded portion 76 is rotatably horizontally mounted in the bearings 73 and 74. Flanges 77 provided on the horizontal drive rod 75 are in contact with the end surfaces of the bearing 73, so that the rod 75 cannot move in the axial direction. The bearings 73 and 74 and horizontal rods 75 are symmetrically mounted on the base frame 71.

In the lower portion 87 of each movable base 85 is a threaded hole 88 into which the threaded portion 76 of the corresponding rod 75 is threaded. Accordingly, when one of the horizontal drive rods 75 is rotated by a handle 78 thereon, the corresponding movable base 85 is moved laterally on the base frame. Each movable base 85 has a roll shaft 107 slidably mounted in a bushing 90 mounted on a lower portion 87 of the base and a bushing 94 mounted on a middle portion 92 of the base. On a top portion 96 of the movable base 85 is a lifting drive rod 100 which is operationally coupled to a worm wheel transmitting mechanism 103, and a threaded rod 105 is connected to the worm wheel transmitting mechanism 102, said rod 105 being raised and lowered by the mechanism 103. The threaded rod 105 is slidably mounted in a bushing 99 fixed to a top portion 96 of the base 85, and the lower end of the rod 105 is connected to the upper end of the roll shaft 107.

A forming roll 111 having a concave recess 112 is rotatably mounted on the roll shaft 107 by a bushing 113. A washer 114 is positioned between the upper end surface of the forming roll 111 and a nut 108 threaded on the roll shaft 107, and the lower end surface is supported by a nut 115 threaded on a threaded portion 109 of the roll shaft 107, thereby preventing the forming roll 111 from shifting vertically with respect to the roll shaft 107. When the lifting drive rod 100 is rotated in one direction by means of a handle 101, the threaded rod 105 is lifted by means of the worm wheel transmitting mechanism 103, and the forming roll 111 is lifted together with the roll shaft 107.

A bottom roll drive rod 82 is rotatably horizontally mounted in bearings 80 and 81 provided on the bottom portion of the base frame 71. This drive rod 82 is operationally coupled to a worm wheel transmitting mechanism 117 mounted on the bottom portion of the base frame 71. The worm wheel transmitting mechanism 117 is operationally coupled with a threaded rod 118 that extends through a bushing 119 mounted on the base frame 71. The upper portion of the threaded rod 118 is threaded into a hole 122 in bottom roll support 121, and the bottom roll support 121 is raised and lowered by the rotation of the threaded rod 118. A bottom roll 125 is rotatably journalled on the bottom roll support 121 by means of a bearing 123. When the bottom roll drive rod 82 is rotated in one direction by means of the handle 83, the bottom roll 125 is raised by the worm wheel mechanism 117 and the threaded rod 118.

The vertical rolls 111 and the bottom roll 125 can be set at predetermined positions according to diameter of the pipe to be manufactured by means of the structure of the U-shape forming stand as described above, and pipes of different diameters can be formed without changing over the rolls.

Embodiment 2.

Figure 5:
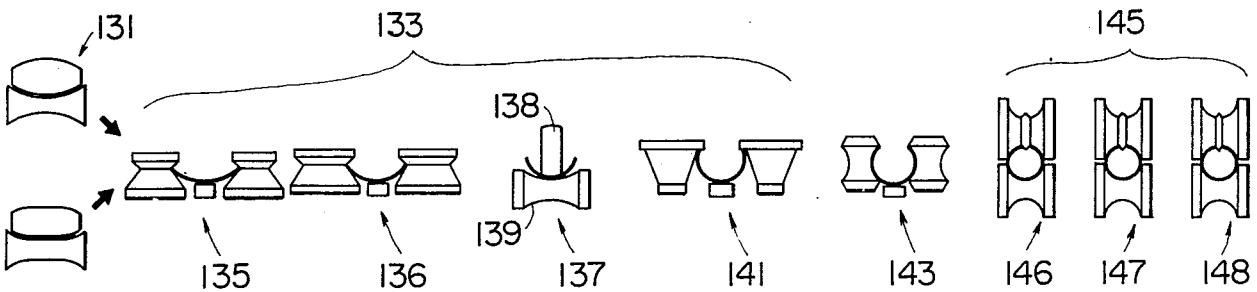
FIG. 5 and FIG. 6 are views similar to FIG. 1 of other embodiments of forming mills of the present invention.

In example of a forming mill suitable for the forming of a thick wall pipe having a small diameter is illustrated in FIG. 5. The forming mill is comprised of a pinch roll stand 131, a train of U-shape forming stands 133, a prefinishing stand 143 and a train of finishing stands 145.

The skelp is fed into a first U-shape forming stand 135 and a second U-shape forming stand 136 by a first pinch roll stand 131 comprised of the pinch rolls 12 or 20 as shown in the first Embodiment illustrated in FIG. 1 or a pinch roll having a roll profile with a single curvature or a pinch roll having a profile with two curved end portions and a straight middle portion. The U-shape forming stands 135 and 136 each have a structure similar to that of the U-shape forming stands 26 and 35 of the preceding Embodiment. The skelp 1 formed by these U-shape forming stands is further formed by a third U-shape forming stand which is a pinch roll stand 137 comprised of a convex top roll 138 having a small axial dimension, and a concave bottom roll 139 having large axial dimension and is fed into a succeeding fourth U-shape forming stand 141 and a prefinishing stand 143. The fourth U-shape forming stand 141 and the prefinishing stand 143 have a structure similar to that of the fourth U-shape forming stand 43 and the prefinishing stand 47 of the first embodiment.

The skelp 1 passing through the train of the U-shape forming stands 133 is finished by being formed by finishing stands 146, 147 and 148 which have a structure similar to that of the train of the finishing stands 51 of the first Embodiment.

As described in the foregoing, the second pinch roll stand 137 is disposed in the train of the U-shape forming stands 133, and by intensifying the indentation force during threading to the succeeding U-shape forming stand 141 and the prefinishing stand 143, the threading of the material for forming a thick wall material can be carried out more easily and smoothly.

Embodiment 3.

Figure 6:
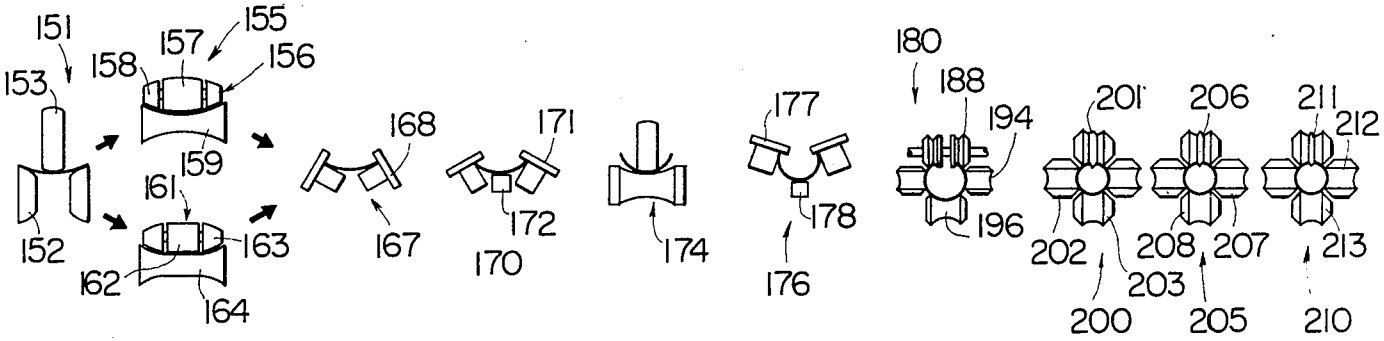

FIG. 6 shows the structure of a forming mill for forming a thin wall pipe having a medium diameter according to the present invention. The forming mill is comprised of a prebending roll stand 151, a first pinch roll stand 155, a train of U-shape forming stands 166, a prefinishing stand 180 and a train of finishing stands 200, 205 and 210.

In the prebending roll stand 151, both edges of the skelp 1 are supported by a pair of spaced bottom rolls 152 and the center of the width of the skelp is pushed down by a top roll 153, whereby the skelp 1 is prebent. As described above, the skelp 1 is supported at three points for carrying out the prebending whereby the edge stretch of the skelp 1 is held down to a small value so that the edge buckling which tends to occur in the initial period of the forming can be prevented.

The prebent skelp 1 is fed to the pinch roll stand 155. The pinch roll is comprised of a combination of a top roll 156 and a bottom roll 159 for producing uniform bending over the entire width or is comprised of a combination of a top roll 161 and a bottom roll 164 for bending only the edge portion 3 of the skelp. The top roll 156 is divided in the axial direction into a central roll 157 and two end rolls 158 and the top roll 161 is also divided in the axial direction into a central roll 162 and two end rolls 163. Since the top rolls 156 and 161 are divided into three parts, the friction due to the engagement with the skelp 1 can be minimized.

In the train of the U-shape forming stands 166, three U-shape forming stands are provided each having a pair of inclined rolls of substantially cylindrical shape with a flange on the upper end. The first U-shape forming stand 167 has only a pair of inclined rolls 168, and the second U-shape forming stand 170 is comprised of a pair of inclined roll 171 and a horizontal roll 172, and the fourth U-shape forming stand 176 is comprised of a pair of inclined roll 177 and a horizontal roll 178. The inclination of the rolls 168 of the first U-shape forming stand 167 is about 40° from the horizontal direction, and the inclination becomes larger the further the stands are along the train from the second U-shape forming stand 170 to the fourth U-shape forming stand 176. The inclined rolls 168, 171 and 177 are substantially identical in shape, and by changing the roll inclination, the inclined rolls can be used for any of the U-shape forming stands. Also, by employing a cylindrical roll with the flange, the rolls can be made small in size and light in weight as compared with the conical roll positioned on a vertical axis. This feature is an important factor in a forming mill for pipe having a medium diameter.

The third forming stand of the train of the U-shape forming stands 166 is comprised of a second pinch roll stand 174. The second pinch roll stand 174 is identical with the second pinch roll 137 is the second Embodiment with respect to structure and operation.

Figure 7:
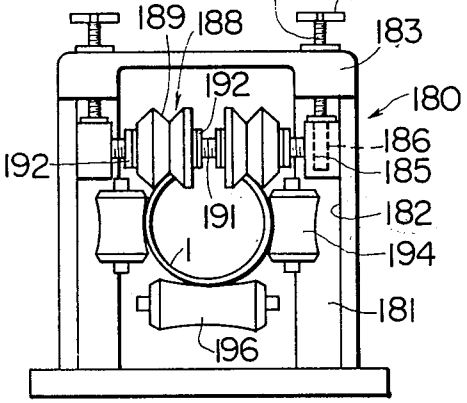
FIG. 7 is an elevation view of a prefinishing stand for use in the forming mill of FIG. 6.

The prefinishing stand 180, as illustrated in FIG. 7, has threaded rods 184 rotatably mounted in bilateral symmetry on a top portion 183 of a frame 181. The lower portion of each threaded rod 184 is threaded into a hole 186 in a support block 185, and the support block 185 is prevented from rotating by engagement with a guide surface 182 on the frame 181. Accordingly, when the threaded rod 184 is rotated by a handle 187, the support block 185 is raised or lowered.

A threaded roll shaft 191 is supported by right and left support blocks 185 and a pair of top rolls 188 each having a concave recess 189 are rotatably supported on this roll shaft 191. The respective top rolls 188 are clamped so as not to be shifted in the axial direction by means of nuts 192 threaded on the roll shaft 191.

A pair of concave vertical rolls and a concave bottom roll 196 are rotatably journalled on the frame 181. By the raising of the threaded rod 184 and the transfer of the top rolls 188 in the axial direction of the rolls by adjustment of the positions of the nuts 192, the concave recesses 189 can be set in a predetermined position.

The top rolls 188 and bottom roll 196 are driven and the vertical rolls 194 and bottom roll 196 are in substantially line contact with the outer surface of the skelp 1.

The train of finishing stands is comprised of the first finishing stand 200 consisting of a top roll with fin 201, a pair of vertical rolls 202 and bottom roll 203 and the second finishing stand 205 consisting of a top roll with fin 206, a pair of vertical rolls 207 and bottom roll 208, and the third finishing stand 210 consisting of a top roll with fin 211, a pair of vertical rolls 212, and bottom roll 213. The top roll and bottom roll of each finishing stand are driven.

Embodiment 4.

Figure 8:
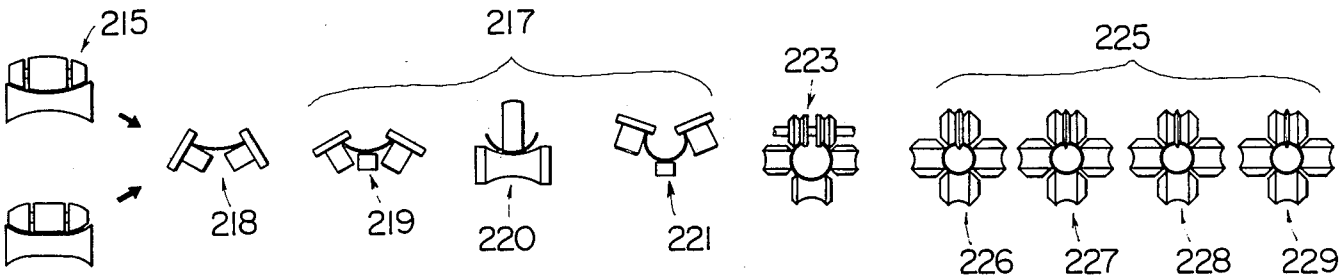

FIG. 8 illustrated an example of a forming mill suitable for forming a thick pipe having a medium diameter according to the present invention. This Embodiment has one more finishing forming roll stand added to the train of finishing stands 225 and omits the prebending roll stand 151 of the third Embodiment. That is, the first pinch roll stand 215 is identical with the roll stand of Embodiment 3 and the train of U-shape forming stands 217 comprised of U-shape forming stands 218, 219, 220 and 221 is identical with the train of the finishing stands 166 of Embodiment 3. The preforming stand 223 is identical with the preforming stand 180 of Embodiment 3. The train of the finishing stands 225 is comprised of first through third finishings stands 226, 227 and 228 and a fourth finishing stand 229. The train of the finishing stands 225 is constructed as described in the foregoing, so that the cross sectional shape of the thick wall pipe can be finished to a better roundness.

Embodiment 5.

Figure 9:
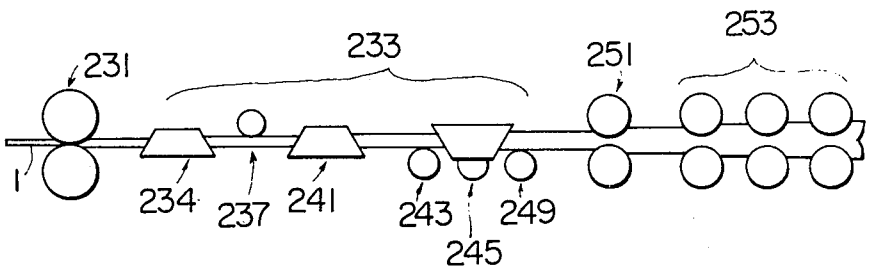
FIG. 8 and FIG. 9 are views similar to FIG. 1 illustrating still other embodiments of the present invention.

FIG. 9 illustrates still another example of the forming mill according to the present invention. In this forming mill, the U-shape forming stands 233 are changed, and the pinch roll stand 231, the prefinishing stand 251, and the train of finishing stands 253 can be selected from among the stands of the preceding embodiment.

Figure 10A:
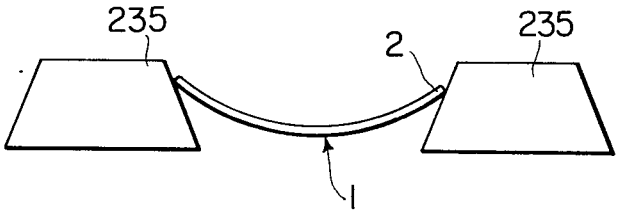
FIGS. 10*a* – 10*c* are elevation views illustrating the arrangement of the rolls of the stands constituting the forming mill illustrated in FIG. 9 and the manner of contact of the rolls and the skelp.
Figure 10B:
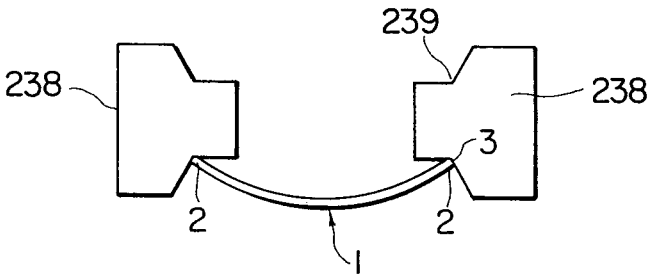
Figure 10C:
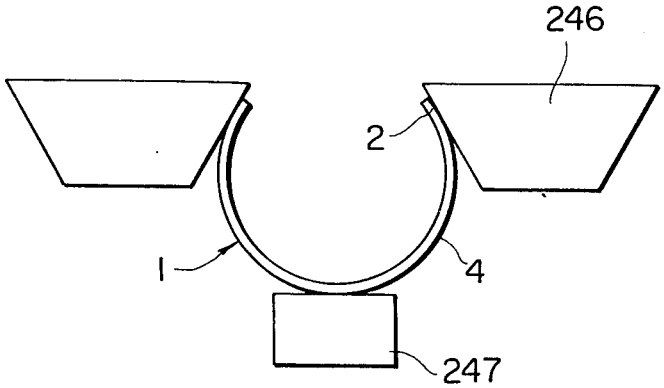

The train of U-shape forming stands 233 is comprised of six U-shape forming stands, stands 234, 237, 241, 243, 245 and 249. The first U-shape forming stand 234 and the third U-shape forming stand 241 are provided with a pair of truncated conical vertical rolls 235 which are rotatable, and in substantially point contact, as seen in FIG. 10*a* the edge portions 2 of the skelp 1 contact the roll surfaces. The second U-shape forming stand 237, the fourth U-shape forming stand 243, and the sixth U-shape forming stand 249, as illustrated in FIG. 10*b*, are provided with a pair of rotatable horizontal rolls 238 provided with concave recesses 239. The skelp 1 is held so that the edge surface 3 contacts the surface of the concave recess 239 of the roll 238. This horizontal roll 238 functions similar to the vertical roll having a concave recess as shown in the above described Embodiments. The fifth U-shape forming stand 245 is comprised of a pair of rotatable inverted truncated conical vertical rolls 246 and a rotatable bottom roll 247, and the outer surface 4 of the skelp 1 is in point contact with these three rolls, respectively.

Figure 11:
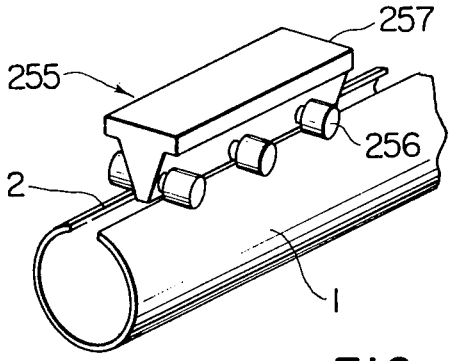
FIG. 11 is a perspective view of an edge guide roll stand for use in the forming mill according to the present invention.
Figure 12:
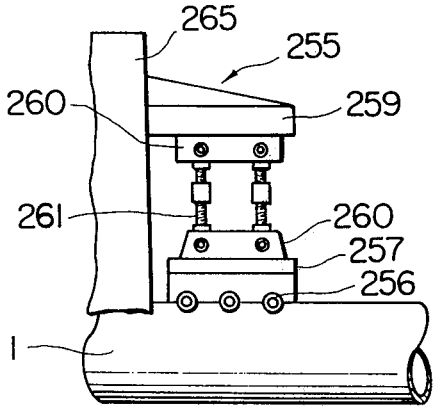
FIG. 12 is a side view of the stand illustrated in FIG. 11.

FIGS. 11 and 12 illustrate an edge guide roll stand 255 which can be disposed between a train of U-shape forming stands and a prefinishing stand, or between a prefinishing stand and a train of finishing stands, or between two stands in a train of finishing stands.

Figure 13:
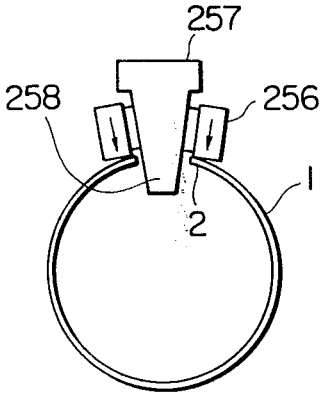
FIG. 13 is an end elevation illustrating another embodiment of the edge guide roll stand.

As illustrated in FIGS. 11 and 12, this stand 255 is comprised of a plurality of sucessive pairs of edge guide rolls 256 and a base 257 on which the guide rolls 256 are rotatably mounted in the direction of advance of the skelp 1. As illustrated in FIG. 13, the roll base 257 can have added thereto a guide 258 for guiding both edges 2 of the skelp 1. The support may be a stand, but as illustrated in FIG. 12, for example, it can comprise a mount fixture 260 on an adjustable threaded mechanism 261 mounted on a bracket 259 fixed on an adjacent finishing stand 265. With this support, the roll base 257 can be shifted vertically by the adjustment of the mechanism 261, and it can be inclined to the pipe axis, and in addition, the edge holding rolls 256 can be mounted so as to be inclinable around their axes and can be made to respond to a change of the forming conditions.

The present invention has the following advantages.

(1) According to the present invention, since the threading is carried out by holding the skelp edge with the rolls stands, the threading can be carried out very easily without causing any trouble due to twisted material.

(2) Since the material (skelp) and the forming rolls are in contact at three point contacts in a plane normal to the pass direction, the friction between the skelp and the forming rolls is reduced and the energy loss due to this friction is very small.

(3) As described in the foregoing, the ratio of the operating time to the changeover time of the installation can be greatly improved for two main reasons, namely the threading is easy, and the number of times that changeover of the forming rolls is required is reduced since the forming rolls can be used for several diameters of pipes.

(4) The number of rolls required to be kept in stock can be greatly reduced.

(5) For pipes the same diameter, if the wall thickness is changed, a changeover is required if the conventional technique is used, but according to the technique of the present invention, even if the wall thickness of the pipe is changed, a changeover of the forming rolls is not required, which is an advantageous point.

(6) Since the edge portion of the skelp is firmly supported by the concave recess in the roll, a pipe having a better roundness can be formed.

What is claimed is:

1. In a method for manufacturing a metal pipe wherein a generally flat skelp is formed into an O-shaped cross-section by feeding the skelp in the longitudinal direction thereof through a forming mill having a train of U-shape forming stands, a prefinishing stand and a train of finishing stands, the improvement comprising: providing in the train of forming stands a plurality of pairs of spaced opposed forming rolls along the length of the train with the rolls of each pair symmetrically rotatably mounted on opposite sides of the centerline of the path of the skelp through the forming mill and having profiles with a generally V-shaped recess therein defined by portions of the roll profile having straight lines with the positions of the V-shaped recesses in the rolls of successive pairs of rolls in the direction toward the output end of the forming mill being further around the periphery of the forming stands from the position of the recess in the first forming stand, supplying the generally flat skelp into the train of said forming stands with at most the edge surfaces in line contact with the roll profiles in the bottoms of said recesses and the outer surface of the skelp adjacent the edges in substantially only point contact with the profiles of each of the pairs of the forming rolls in the bottoms of said recesses for holding the skelp so as to apply a bending load to the skelp, the successive pairs of rolls forming the skelp into an increasingly U-shaped skelp.

2. The improvement as claimed in claim 1 further comprising providing as the prefinishing stand a pair of spaced opposed rollers symmetrically disposed on opposite sides of the centerline of the path of the skelp through the forming mill in the same transverse direction as the rolls of said forming stands are spaced and having concavely curved profiles with a radius of curvature larger than the radius of curvature of the U-shaped skelp coming from the last of said succession of said pairs of forming rolls, and contacting the peripheral surface of the U-shaped skelp with said vertical rollers in substantially point contact for bending the skelp into a shape having a more nearly O-shaped cross section.

3. The improvement as claimed in claim 1 further comprising feeding the skelp forcedly into the train of forming stands and through the prefinishing stand into driving engagement by said finishing stands by engaging the skelp by a pair of pinch rolls and driving at least one of the pinch rolls.

4. In an apparatus for manufacturing a metal pipe from a generally flat skelp and having a forming mill with a train of U-shape forming stands, a prefinishing stand and a train of finishing stands, the improvement comprising, in the forming stands, a plurality of pairs of spaced opposed forming rolls along the length of the forming mill with the rolls of each pair symmetrically rotatably mounted on opposite sides of the centerline of the path of the skelp through the forming mill and having profiles with a generally V-shaped recess therein defined by portions of the roll profile having straight lines for holding said skelp with at most the edge surfaces thereof in line contact with the roll profile in the bottoms of said recesses and the outer surface of the skelp adjacent the edges in substantially only point contact with the profiles of each of the pairs of forming rolls in the bottoms of said recesses so as to apply a bending load to the skelp, means in each stand for mounting said rolls for movement toward and away from each other and for movement transversely to the direction of movement of the rollers toward and away from each other and in the direction of bending of the skelp, the positions of the V-shaped recesses in the rolls of successive pairs of rolls in the direction toward the output end of the forming mill being further around the periphery of the forming stands from the position of the recess in the first forming stand.

5. The improvement as claimed in claim 4, further comprising, as the prefinishing stand, a pair of spaced opposed rollers symmetrically disposed on opposite sides of the centerline of the path of the skelp through the forming mill in the same transverse direction as the rolls of said forming stands are spaced and having concavely curved profiles with a radius of curvature larger than the radius of curvature of the U-shaped skelp coming from the last of the succession of the pairs of forming rolls.

6. The improvement as claimed in claim 4 further comprising a skelp supply means comprised of a pair of pinch rolls.

7. The improvement as claimed in claim 4 in which said forming rolls of each pair are rotatable about parallel axes which are perpendicular to the direction of movement of said rollers toward and away from each other and which lie in a plane transverse to the length of the forming mill.

8. The improvement as claimed in claim 7 in which said train of forming rolls further has a stand having a convexly curved profile roll on the side of the stand toward which the skelp is being bent and a concavely curved profile roll opposed to said covexly curved roll and spaced from the convexly curved roll for engaging the skelp therebetween for further bending the skelp.

9. The improvement as claimed in claim 4 in which said forming rolls of each pair are rotatable about axes which are inclined in opposite directions to the direction of movement of said rolls toward and away from each other and which lie in a plane transverse to the length of the forming mill.

10. The improvement as claimed in claim 9 in which said train of forming rolls further has a stand having a convexly curved profile roll on the side of the stand toward which the skelp is being bent and a concavely curved profile roll opposed to said convexly curved roll and spaced from the convexly curved roll for engaging the skelp therebetween for further bending the skelp.

11. The improvement as claimed in claim 4 further comprising, as the prefinishing stand, a pair of spaced opposed rolls symmetrically disposed on opposite sides of the centerline of the path of the skelp through the forming mill in the same transverse direction as the rolls of said forming stands are spaced, and having concavely curved profiles and rotatable around axes perpendicular to the direction of spacing and lying in a plane transverse to the length of the forming mill, means on which said concavely curved rolls are mounted for movement toward and away from each other, a pair of coaxial rolls lying on an axis in said plane which is parallel to the said transverse direction and adjacent one end of said concavely curved rolls, said coaxial rolls having concave V-shaped recesses therein and being movable toward and away from each other on said axis, and a further roll lying on an axis in said plane which is parallel to said transverse direction and adjacent the other end of said concavely curved rolls, said further roll being between the other ends of said concavely curved rolls.

12. The improvement as claimed in claim 4 further comprising an edge guide roll stand positioned along the length of said train where the skelp has been bent into a shape which is nearly an O-shaped cross-section and having at least one pair of rotatable rolls thereon for contacting the outer surface of the skelp adjacent the edges thereof.

13. The improvement as claimed in claim 12 in which said edge guide roll stand is between the train of U-shape forming stands and the prefinishing stand.

14. The improvement as claimed in claim 12 in which said edge guide roll stand is between the prefinishing stand and the train of finishing stands.

15. The improvement as claimed in claim 4 further comprising a prebending stand positioned ahead of said train of forming stands and having a pair of spaced rolls rotatable around a common axis, and spaced for supporting the edges of the skelp, and a rotatable roll rotatable around an axis parallel to said common axis and substantially midway between said spaced rolls for engaging the middle of the width of the skelp.

16. In an apparatus for manufacturing a metal pipe from a generally flat skelp and having a forming mill with a train of U-shape forming stands, a prefinishing stand and a train of finishing stands, the improvement comprising, in the forming stands, a plurality of pairs of spaced opposed forming rolls along the length of the forming mill with the rolls of each pair symmetrically rotatably mounted on opposite sides of the centerline of the path of the skelp through the forming mill and having a truncated conical roll surface oriented in one direction from a line transverse to the length of the forming mill, a further pair of spaced opposed forming rolls along the length of the forming mill succeeding the last pair of said plurality of pairs of rolls, the rolls of said further pair of rolls being symmetrically rotatably mounted on opposite sides of the centerline of the path of the skelp and having a truncated conical roll surface oriented in the opposite direction to the rolls of said plurality of pairs of rolls, a further roll adjacent the smaller ends of said rolls of said further pair of rolls and rotatable around an axis transverse to the said smaller ends of said further pair of rolls and positioned between said further pair of rolls, and a further plurality of pairs of rolls, one pair being positioned between each adjacent pair of said firstmentioned pairs of rolls, one pair between the last pair of said firstmentioned pairs of rolls and said further pair of rolls and one pair on the opposite side of said further pair of rolls in the direction of the length of said forming mill, the rolls of said further plurality of pairs of rolls being coaxially rotatably mounted around an axis transverse to the rolls of the firstmentioned pairs of rolls and spaced from each other and having V-shaped recesses therein, said rolls of said further plurality of pairs of rolls being on the opposite side of the path of the skelp through said forming mill from the rolls of said firstmentioned pairs of rolls and the V-shaped recesses opening toward the positions of the edges of the skelp moving along the path of the skelp through said forming mill.

* * * * *